US010380953B2

(12) United States Patent
Wu et al.

(10) Patent No.: US 10,380,953 B2
(45) Date of Patent: Aug. 13, 2019

(54) ELECTROPHORETIC DISPLAY AND METHOD FOR DRIVING PANEL THEREOF

(71) Applicant: E Ink Holdings Inc., Hsinchu (TW)

(72) Inventors: Yan-Liang Wu, Taoyuan County (TW); Chi-Mao Hung, Taoyuan County (TW); Wei-Min Sun, Taoyuan County (TW); Pei-Lin Tien, Taoyuan County (TW); Chih-Yuan Hsu, Taoyuan County (TW); Yao-Jen Hsieh, Taoyuan County (TW); Hsiao-Lung Cheng, Taoyuan County (TW)

(73) Assignee: E Ink Holdings Inc., Hsinchu (TW)

( * ) Notice: Subject to any disclaimer, the term of this patent is extended or adjusted under 35 U.S.C. 154(b) by 606 days.

(21) Appl. No.: 14/162,776

(22) Filed: Jan. 24, 2014

(65) Prior Publication Data

US 2014/0204012 A1 Jul. 24, 2014

(30) Foreign Application Priority Data

Jan. 24, 2013 (TW) ..... 102102686 A

(51) Int. Cl.
*G09G 3/34* (2006.01)

(52) U.S. Cl.
CPC ..... *G09G 3/344* (2013.01)

(58) Field of Classification Search
USPC ..... 345/107; 359/296
See application file for complete search history.

(56) References Cited

U.S. PATENT DOCUMENTS

2004/0155873 A1* 8/2004 Miyazawa ..... G09G 3/325
345/204
2005/0162377 A1* 7/2005 Zhou ..... G09G 3/34
345/107

(Continued)

FOREIGN PATENT DOCUMENTS

CN 1849638 10/2006
CN 1866340 11/2006

(Continued)

OTHER PUBLICATIONS

"Office Action of Taiwan Counterpart Application", dated Mar. 30, 2015, p. 1-p. 3, in which the listed references were cited.

(Continued)

*Primary Examiner* — Chineyere D Wills-Burns
(74) *Attorney, Agent, or Firm* — JCIPRNET

(57) ABSTRACT

An electrophoretic display and method for driving panel using the same are provided. The electrophoretic display includes a display panel and a driving circuit. The display panel includes a plurality of column data lines and a plurality of row scan lines. The driving circuit provides a plurality of data driving signals to the column data lines, and provides a plurality of scan signals to row scan lines. Each of the scan signals has a plurality of scan enable periods, and each of the scan enable periods includes a plurality of scan interval periods. Each of the scan signals is floating or grounding during the scan interval periods. Each of the data driving signals includes a plurality of data driving periods, and each of the data driving periods includes a plurality of driving interval period. Each of the data driving signals is floating or grounding during the driving interval period.

15 Claims, 6 Drawing Sheets

(56) References Cited

U.S. PATENT DOCUMENTS

2008/0238865 A1* 10/2008 Maeda ..... G09G 3/344 345/107
2009/0231267 A1* 9/2009 Uchida ..... G09G 3/16 345/107
2010/0194793 A1* 8/2010 Uehara ..... G09G 3/20 345/691
2011/0090186 A1* 4/2011 Yamazaki ..... G09G 3/344 345/204
2011/0102480 A1* 5/2011 Miyasaka ..... G04G 9/0005 345/690
2011/0141086 A1* 6/2011 Huang ..... G09G 3/344 345/211
2011/0157136 A1* 6/2011 Kim ..... G09G 3/344 345/211
2011/0199364 A1* 8/2011 Yamazaki ..... G09G 3/3614 345/212
2012/0262439 A1* 10/2012 Chu ..... G09G 3/344 345/212
2013/0127814 A1* 5/2013 Lee ..... G09G 3/344 345/212
2014/0375537 A1* 12/2014 Chung ..... G09G 3/344 345/107
2016/0370635 A1* 12/2016 Tanaka ..... G02F 1/1368

FOREIGN PATENT DOCUMENTS

| | | |
|---|---|---|
| CN | 1967366 | 5/2007 |
| JP | 2012189828 | 10/2012 |
| TW | 382685 | 2/2000 |
| TW | 200525469 | 8/2005 |
| TW | 200530970 | 9/2005 |
| TW | 200620194 | 6/2006 |
| TW | 201039309 | 11/2010 |

OTHER PUBLICATIONS

"Office Action of Taiwan Counterpart Application", dated Dec. 27, 2014, p. 1-p. 5, in which the listed reference was cited.
"Office Action of China Counterpart Application", dated Aug. 6, 2015, p. 1-p. 6, in which the listed references were cited.

* cited by examiner

ELECTROPHORETIC DISPLAY AND METHOD FOR DRIVING PANEL THEREOF

CROSS-REFERENCE TO RELATED APPLICATION

This application claims the priority benefit of Taiwan application serial no. 102102686, filed on Jan. 24, 2013. The entirety of the above-mentioned patent application is hereby incorporated by reference herein and made a part of this specification.

BACKGROUND

Technical Field

The invention relates to a planar display technique. Particularly, the invention relates to an electrophoretic display and a method for driving a panel thereof.

Related Art

Generally, an electrophoretic display applies an electrophoretic display technique to achieve an image display effect. Taking a color e-book as an example, each pixel therein is mainly composed of a red electrophoresis solution, a green electrophoresis solution and a blue electrophoresis solution doped with white charged particles and formed in different micro-cups, and a voltage is applied to drive the white charged particles to move, such that each pixel can display a color between the darkest black to the brightest white.

However, the conventional panel driving technique generally has a cross talk phenomenon caused by a capacitive coupling effect. An example is provided below to schematically describe the cross talk phenomenon and an influence thereof.

FIG. 1 is a display status diagram of an electrophoretic display panel 10. In FIG. 1, the electrophoretic display panel 10 totally displays 9 pixels P11-P33, where the pixels P11, P13, P22, P31 and P33 display black, and the pixels P12, P21, P23 and P32 display white. In the conventional electrophoretic display panel 10, taking the pixel P22 displaying black as an example, since the surrounding pixels P21, P12, P32 and P23 all display white, the black presented by the pixel P22 is influenced by the pixels P21, P12, P32 and P23 that display white and is not black enough, and such phenomenon is the so-called cross talk phenomenon. Such phenomenon is also occurred on the pixel P21 displaying white.

Therefore, it is an important issue to decrease or avoid the cross talk phenomenon of the display panel generated during the display process.

SUMMARY

Accordingly, the invention is directed to a driving method of an electrophoretic display, by which a cross talk problem of the electrophoretic display is mitigated.

The invention provides an electrophoretic display including a display panel and a driving circuit. The display panel includes a plurality of column data lines and a plurality of row scan lines. The driving circuit is coupled to the display panel, and respectively provides a plurality of data driving signals to the column data lines, and respectively provides a plurality of scan signals to the row scan lines. Each of the scan signals has a plurality of scan enable periods, and each of the scan enable periods includes a plurality of scan interval periods. The driving circuit makes each of the scan signals to be floating or grounding during the scan interval periods. Each of the data driving signals includes a plurality of data driving periods, and each of the data driving periods includes a plurality of driving interval periods. The driving circuit makes each of the data driving signals to be floating or grounding during the driving interval periods.

The invention provides a method for driving an electrophoretic display, the electrophoretic display has a display panel, and the display panel includes a plurality of column data lines and a plurality of row scan lines. The method includes following steps. A plurality of data driving signals are respectively provided to the column data lines, and a plurality of scan signals are respectively provided to the row scan lines. Each of the scan signals has a plurality of scan enable periods, and each of the scan enable periods includes a plurality of scan interval periods. Each of the data driving signals includes a plurality of data driving periods, and each of the data driving periods includes a plurality of driving interval periods. Each of the scan signals is floating or grounding during the scan interval periods, and each of the data driving signals is floating or grounding during the driving interval periods.

According to the above descriptions, the invention provides an electrophoretic display and a method for driving a panel thereof, by which the specially designed data driving signals and scan signals are used to drive a plurality of pixels, so as to mitigate the cross talk problem of the display panel and the influence on quality of the display image.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

Figure 2:
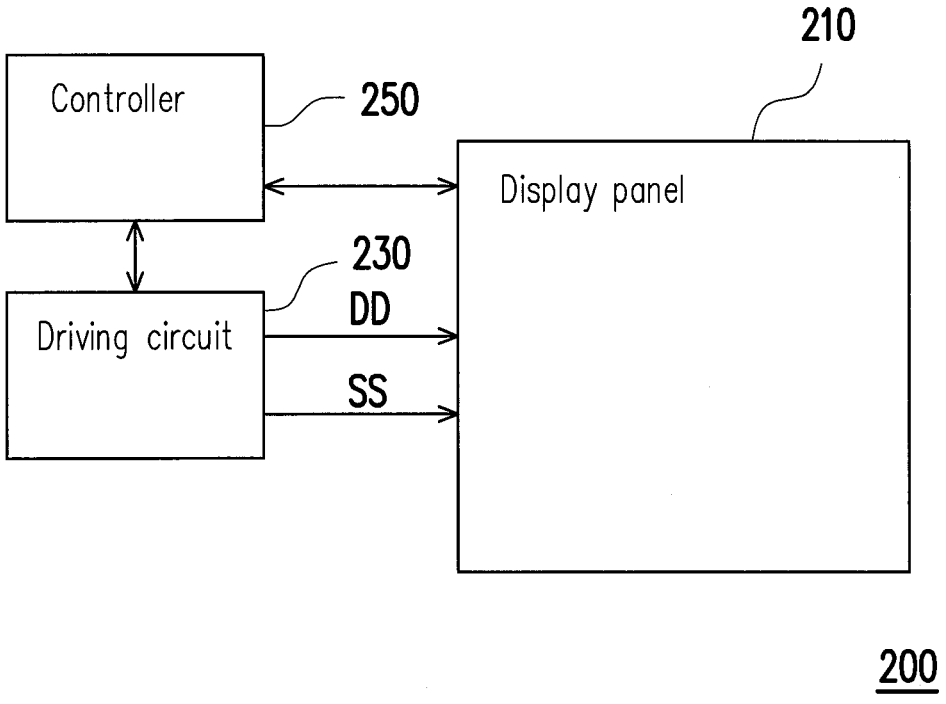
FIG. 2 is a schematic diagram of an electrophoretic display according to an embodiment of the invention.

Referring to FIG. 2, FIG. 2 is a schematic diagram of an electrophoretic display 200 according to an embodiment of the invention. In FIG. 2, the electrophoretic display 200 includes a display panel 210, a driving circuit 230 and a controller 250. The controller 250 is coupled to the driving circuit 230, and the driving circuit 230 is coupled to the display panel 210. The driving circuit 230 is controlled by control signals provided by the controller 250 to respectively provide a plurality of data driving signals DD and scan signals SS to column data lines and row scan lines on the display panel 210, so as to drive the display panel 210 to display required images.

Figure 3A:
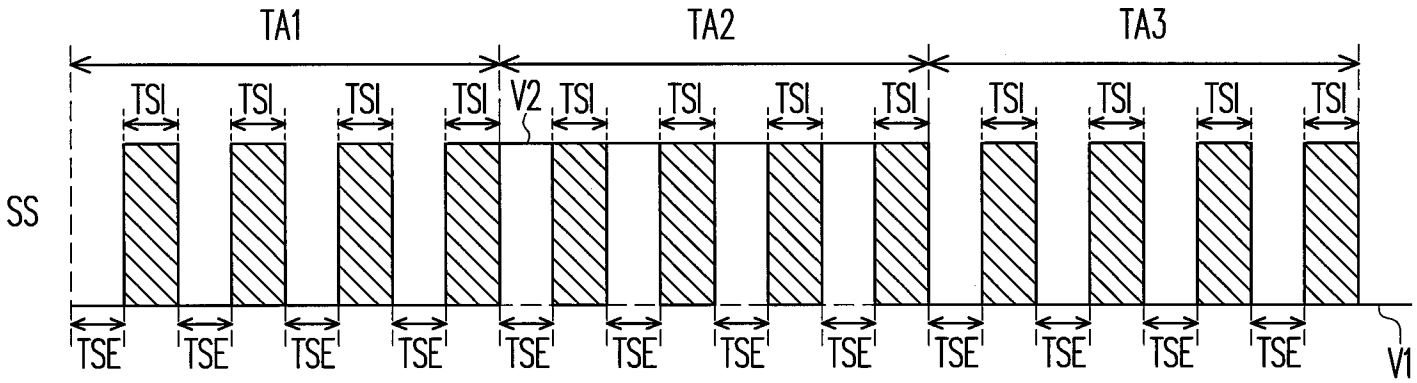
FIG. 3A is a waveform diagram of a scan signal according to an embodiment of the invention.

In the present embodiment, each of the scan signals SS provided by the driving circuit 230 includes a plurality of scan enable periods, and each of the scan enable periods includes a plurality of scan interval periods. Referring to FIG. 2 and a waveform diagram of the scan signal SS of FIG. 3A. The scan signal SS includes a plurality of scan enable periods TA1, TA2 and TA3, and each of the scan enable periods TA1, TA2 and TA3 includes a plurality of scan interval periods TSI and a plurality of time sections TSE other than the scan interval periods TSI. In the present embodiment, in the time sections TSE of the scan enable periods TA1 and TA3, a voltage value of the scan signal SS is equal to equal to a display reference voltage V1, and in the time sections TSE of the scan enable period TA2, the voltage value of the scan signal SS is equal to equal to a display reference voltage V2. The display reference voltage V1 is smaller than the display reference voltage V2. The display reference voltage V1 can be a ground voltage (0 volt), and the display reference voltage V2 can be 15 volts.

It should be noticed that in the scan interval periods TSI of the scan enable periods TA1, TA2 and TA3, the scan signal SS is maintained to be floating. Namely, in the scan interval periods TSI of the scan enable periods TA1, TA2 and TA3, the scan signal SS provided by the driving circuit 230 does not have a driving capability and is in a high impedance state.

Figure 3B:
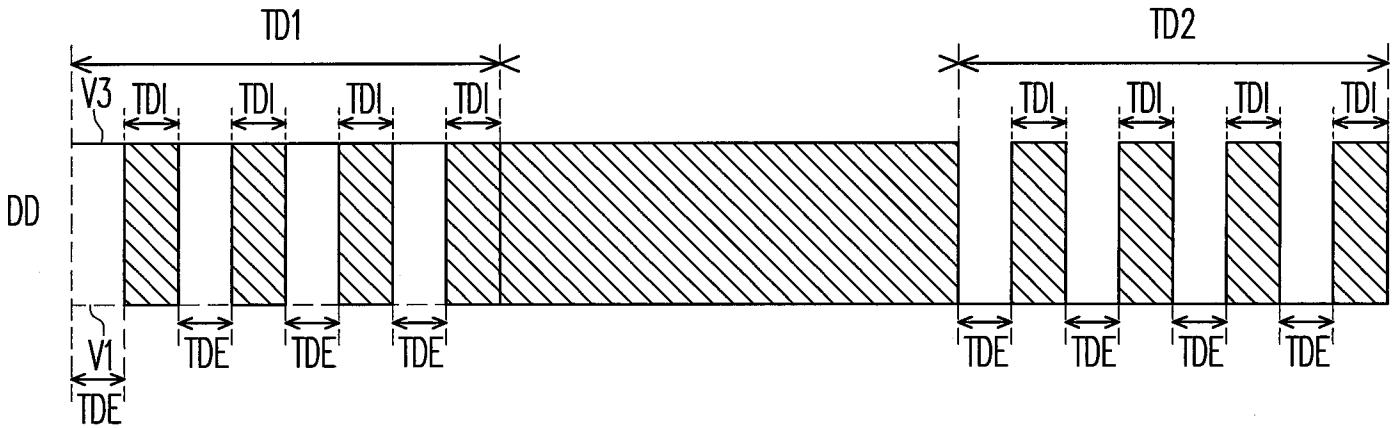
FIG. 3B is a waveform diagram of a data driving signal according to an embodiment of the invention.

Moreover, each of the data driving signals DD includes a plurality of data driving periods, and each of the data driving periods includes a plurality of driving interval periods. Referring to FIG. 2 and a waveform diagram of the data driving signal DD of FIG. 3B. The data driving signal DD includes a plurality of data driving periods TD1 and TD2, and each of the data driving periods TD1 and TD2 includes a plurality of driving interval periods TDI and a plurality of time sections TDE other than the driving interval periods TDI. It should be noticed that in the present embodiment, the data driving signals DD is floating (i.e. in the high impedance state) during the driving interval periods TDI, and in the time sections TDE other than the driving interval period TDI, the data driving signal DD is equal to a display reference signal V3. Moreover, in the time sections TDE of the data driving period TD2, the data driving signal DD is equal to the display reference signal V1, where the display reference voltage V3 is greater than the display reference voltage V1, and the display reference voltage V1 can be equal to the ground voltage (0 volt), and the display reference voltage V3 can be determined by display data displayed during the data driving period TD1 according to the data driving signal DD.

Figure 4:
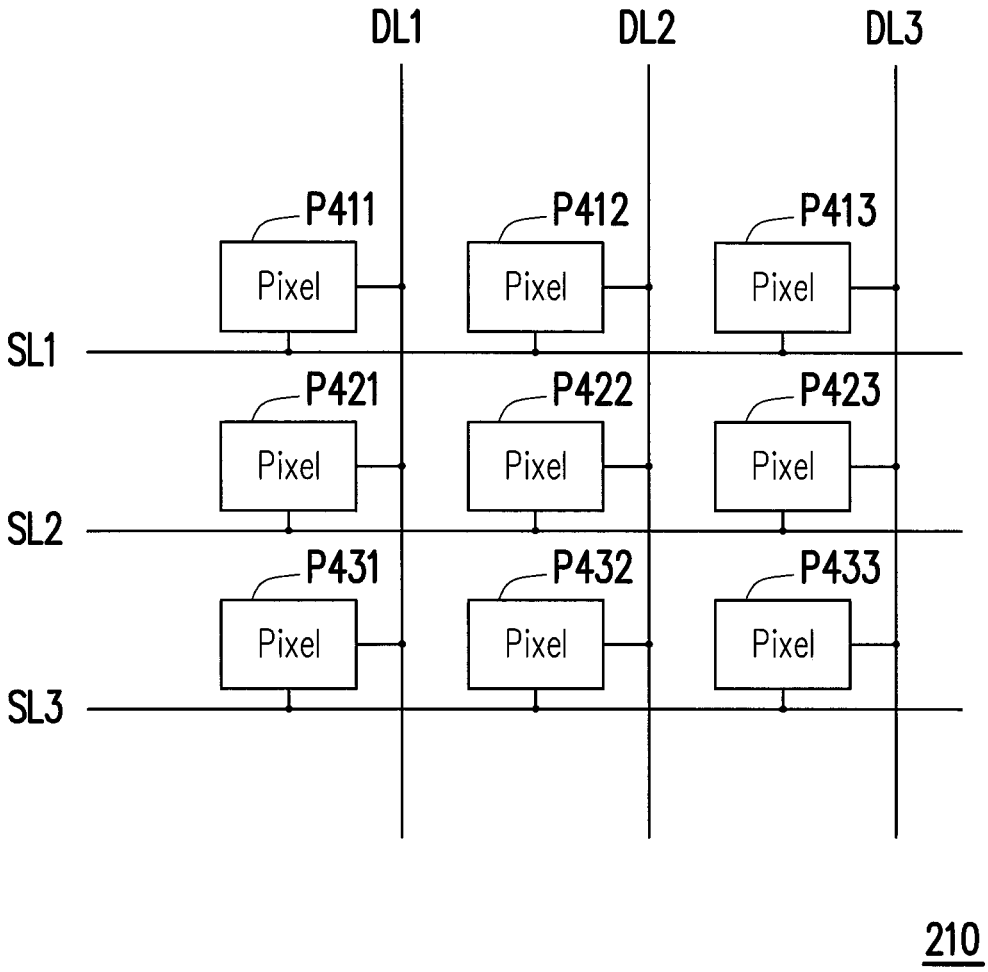
FIG. 4 is a schematic diagram of a display panel according to another embodiment of the invention.
Figure 5:
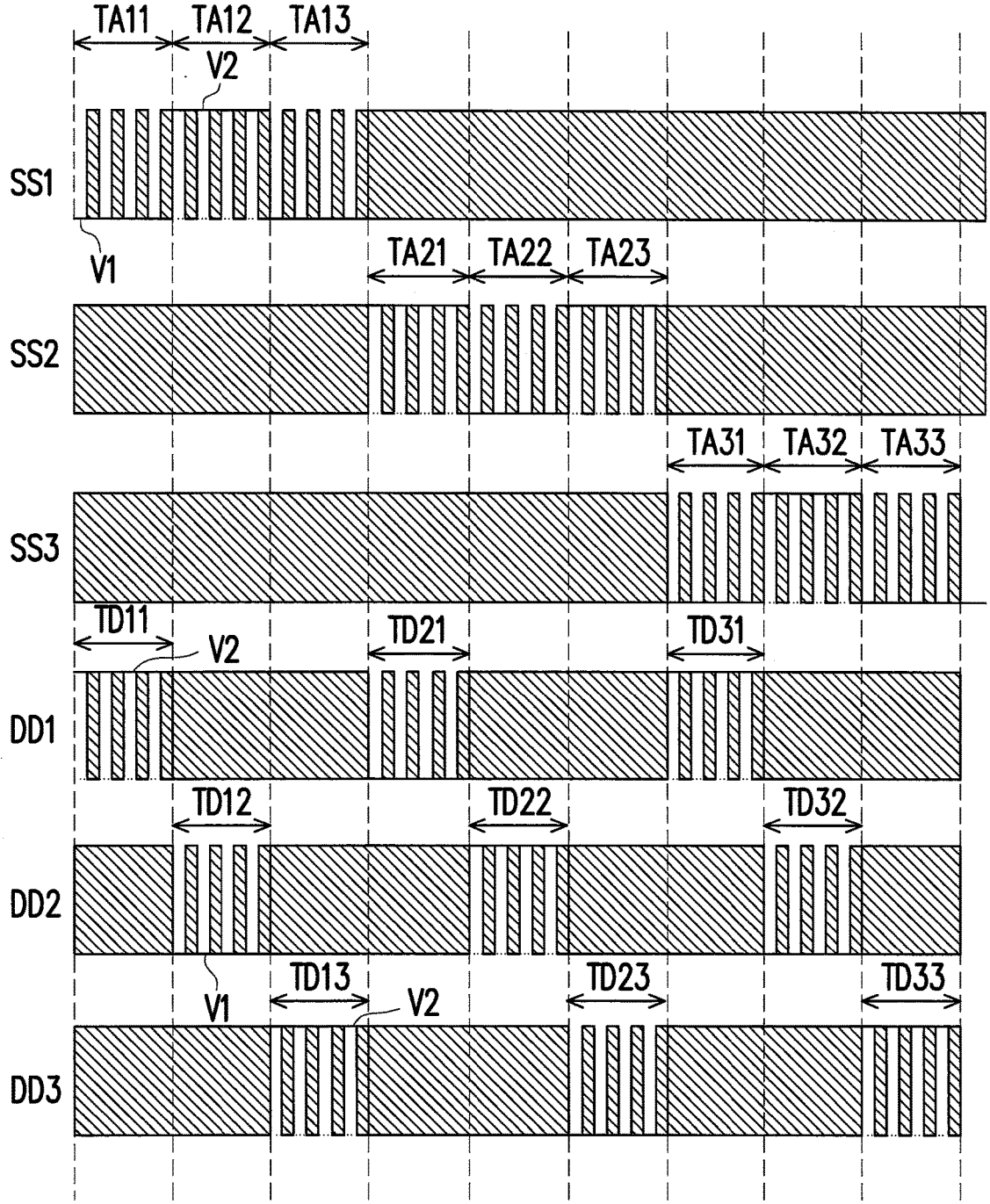
FIG. 5 is a driving waveform diagram of a display panel according to an embodiment of the invention.

Referring to FIG. 4 and FIG. 5, FIG. 4 is a schematic diagram of a display panel 210 according to an embodiment of the invention, and FIG. 5 is a driving waveform diagram of the display panel 210. The display panel 210 includes column data lines DL1-DL3, row scan lines SL1-SL3 and pixels P411-P413, P421-P423 and P431-P433. The column data lines DL1-DL3 are approximately perpendicular to the row scan lines SL1-SL3. Moreover, the pixels P411-P413, P421-P423 and P431-P433 are arranged in an array, and are electrically connected to the corresponding column data lines DL1-DL3 and the row scan lines SL1-SL3 (for example, the pixel P411 is electrically connected to the column data line DL1 and the row scan line SL1, and the others are deduced by analogy).

Figure 1:
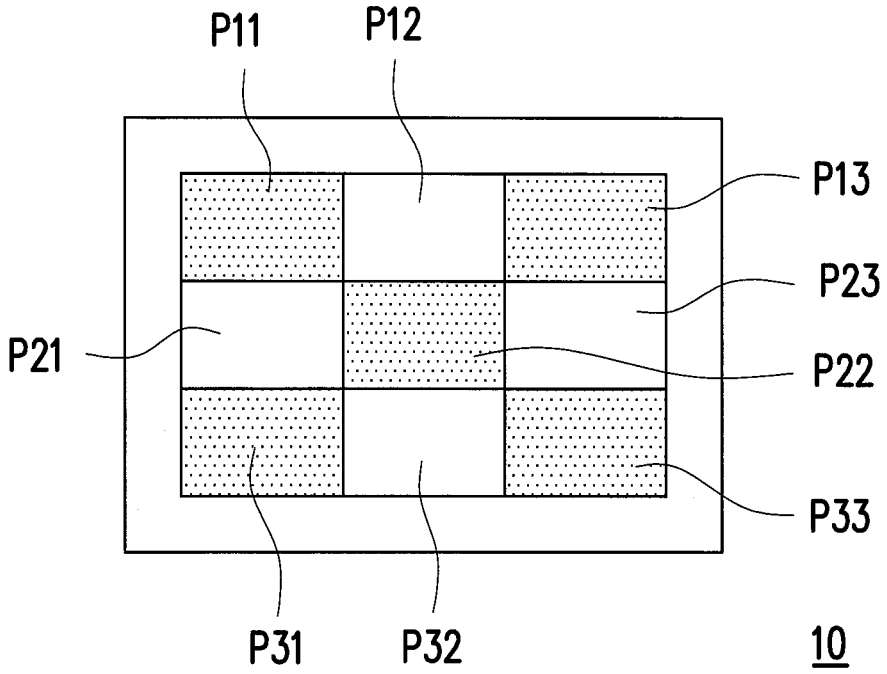
FIG. 1 (RELATED ART)
FIG. 1 is a display status diagram of an electrophoretic display panel.

The driving circuit 230 is coupled to the display panel 210, and respectively provides a plurality of data driving signals DD1-DD3 to the column data lines DL1-DL3, and provides a plurality of scan signals SS1-SS3 to the row scan lines SL1-SL3. The data driving signals DD1-DD3 and the scan signals SS1-SS3 can be determined by the display image to be displayed by the display panel 210. For example, when the image to be displayed by the display panel 210 is a black and white interlaced quincunx-type display image as that shown in FIG. 1, the driving circuit 230 provides the data driving signals DD1-DD3 and the scan signals SS1-SS3 to the pixels P411-413, P421-P423 and P431-P433 according to the display image and a material characteristic of the display panel 210 to drive the same to respectively display the corresponding gray levels.

In the present embodiment, taking the scan signal SS1 as an example, the scan signal SS1 includes a plurality of scan enable periods TA11-TA13, and the scan enable periods TA11-TA13 of the scan signal SS1 respectively correspond to data driving periods TD11-TD13 of the data driving signals DD1-DD3. The scan signal SS1 is used to control the pixels P411-P413 on the display panel 210, and in the scan enable period TAU, by calculating a negative voltage difference between the scan signal SS1 in the scan enable period TA11 and the corresponding data driving signal DD1 in the data driving period TD11 (which is equivalent to the display reference voltage V1−the display reference V2), it is known that the pixel P411 displays a black pattern.

Referring to FIG. 4 and FIG. 5, in the scan enable period TA12 of the scan signal SS1, by calculating a positive voltage difference between the scan signal SS1 and the data driving signal DD2 in the data driving period TD12 (which is equivalent to the display reference voltage V2−the display reference voltage V1), it is known that the pixel P412 displays a white pattern. Moreover, in the scan enable period TA13 of the scan signal SS1, by calculating a negative voltage difference between the scan signal SS1 and the data driving signal DD3 in the data driving period TD13 (which is equivalent to the display reference voltage V1−the display reference voltage V2), it is known that the pixel P413 displays a black pattern.

Similarly, by calculating a positive voltage difference and a negative voltage difference between the scan signal SS2 in the scan enable periods TA21-TA23 and the data driving signals DD1-DD3 in the corresponding data driving periods TD21-TD23, the display pattern (black or white) of the pixels P421-P423 is known. Moreover, by calculating a positive voltage difference and a negative voltage difference between the scan signal SS3 in the scan enable periods TA31-TA33 and the data driving signals DD1-DD3 in the corresponding data driving periods TD31-TD33, the display pattern of the pixels P431-P433 is known. It should be noticed that as the operation method of the present embodiment has been described in detail in the aforementioned paragraph, details thereof are not repeated.

It should be noticed that one of the data driving periods TD11-TD13, TD21-TD23 and TD31-TD33 of the data driving signals DD1-DD3 corresponds to one of the scan enable periods TA11-TA13, TA21-TA23 and TA31-TA33 of the scan signals SS1-SS3, and in the corresponding data driving periods TD11-TD13, TD21-TD23 and TD31-TD33 and the scan enable periods TA11-TA13, TA21-TA23 and TA31-TA33, each of the scan interval periods TSI corresponds to each of the driving interval periods TDI.

However, the invention is not limited thereto, in another embodiment of the invention, the driving circuit makes each of the scan signals to be floating or grounding during the scan interval periods.

Figure 6:
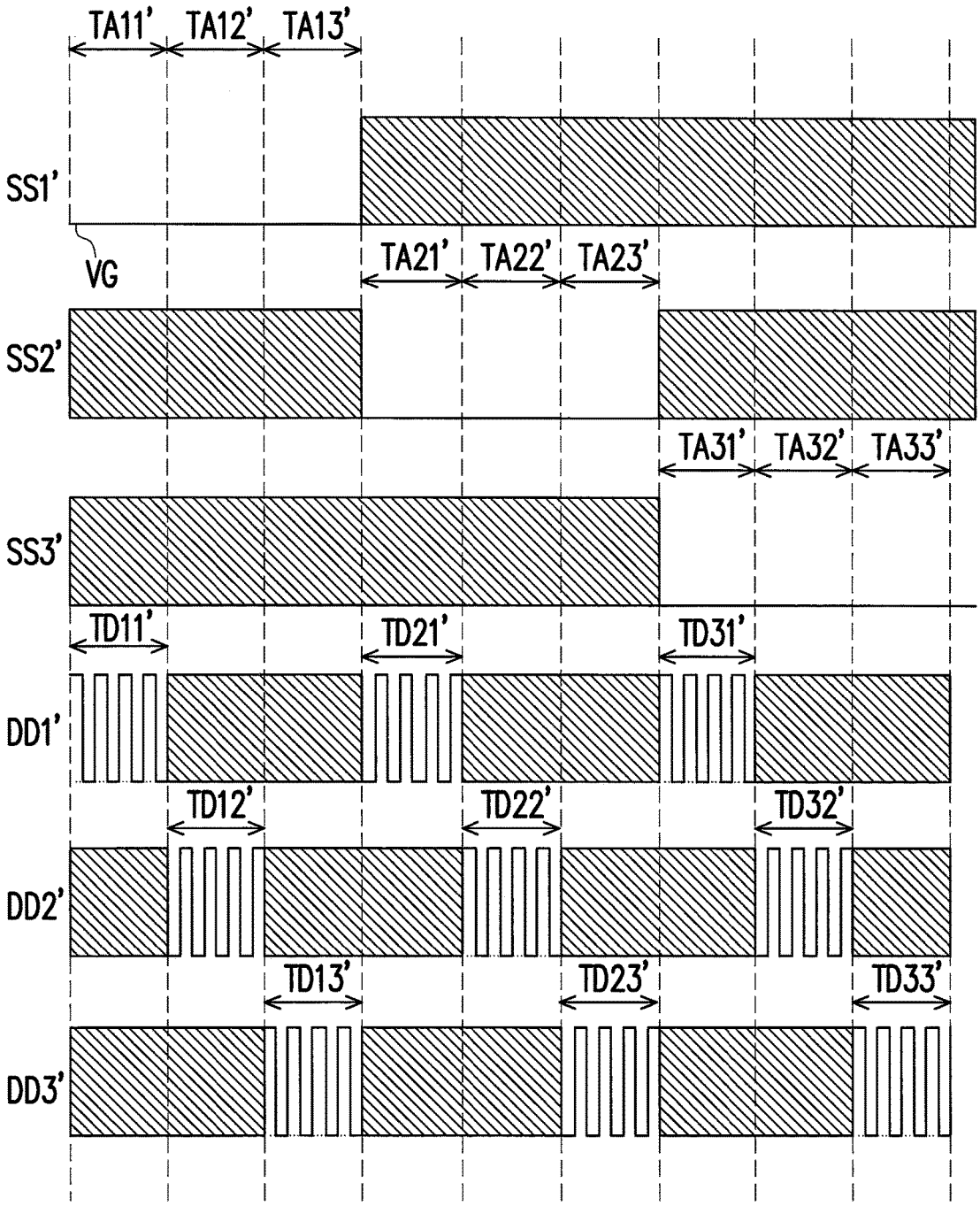
FIG. 6 is a driving waveform diagram of a display panel according to another embodiment of the invention.

Referring to FIG. 4 and FIG. 6, FIG. 6 is a driving waveform diagram of a display panel 210 according to another embodiment of the invention. Similar to FIG. 5, in the present embodiment, when the image to be displayed by the display panel 210 is a black and white interlaced quincunx-type display image as that shown in FIG. 1, the driving circuit 230 provides the data driving signals DD1'-DD3' and the scan signals SS1'-SS3' to the pixels P411-413, P421-P423 and P431-P433 according to the display image and a material characteristic of the display panel 210 to drive the same to respectively display the corresponding gray levels.

Similar to FIG. 5, in the present embodiment, the scan signals SS1'-SS3' respectively include scan enable periods TA11'-TA13', TA21'-TA23' and TA31'-TA33', and the scan enable periods TA11'-TA13', TA21'-TA23' and TA31'-TA33' respectively correspond to data driving periods TD11'-TD13', TD21'-TD23' and TD31'-TD33' of the data driving signals DD1'-DD3'.

In detail, a difference between the present embodiment and the embodiment of FIG. 5 is that in the scan enable periods TA11'-TA13', TA21'-TA23' and TA31'-TA33' of the scan signals SS1'-SS3' of the present embodiment, the scan signals SS1'-SS3' are grounding. In other words, in the present embodiment, the scan enable periods TA11'-TA13', TA21'-TA23' and TA31'-TA33' can be directly regarded as the scan interval periods included therein.

In detail, referring to FIG. 4 and FIG. 6, taking the scan signal SS1' as an example, in the scan enable periods TA11'-TA13', the scan signal SS1' has a ground voltage VG. In periods other than the scan enable periods TA11'-TA13' of the scan signal SS1', the scan signal SS1' is floating. The scan signals SS2' and SS3' can be deduced by analogy, and details thereof are not repeated.

Similarly, in periods other than the data driving periods TD11'-TD13', TD21'-TD23' and TD31'-TD33' of the data driving signals DD1'-DD3', the data driving signals DD1'-DD3' are all floating. In this way, according to its own signal waveform of each of the data driving signals DD1'-DD3', patterns of the pixels P411-P413, P421-P423 and P431-P433 can be directly obtained (for example, the pixels P411 and P413 display black, and the pixel P412 displays white, etc.), and meanwhile the cross talk phenomenon of the display panel can be effectively mitigated through potential floating.

Figure 7:
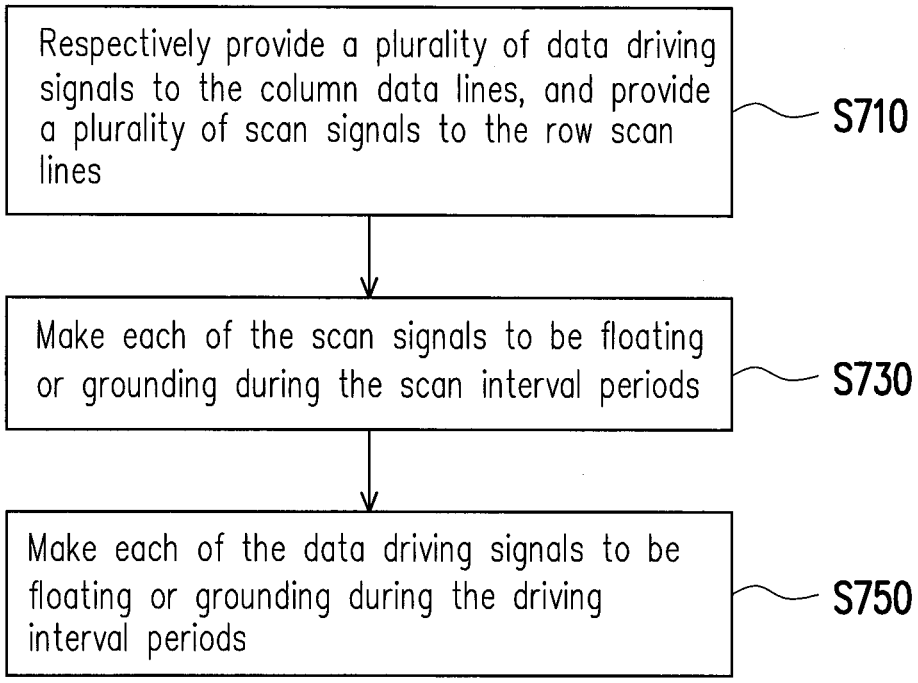
FIG. 7 is a flowchart illustrating a driving method according to an embodiment of the invention.

FIG. 7 is a flowchart illustrating a driving method according to an embodiment of the invention. Referring to FIG. 7, in step S710, the driving circuit respectively provides a plurality of data driving signals to the column data lines, and provides a plurality of scan signals to the row scan lines. Each of the scan signals has a plurality of scan enable periods, and each of the scan enable periods includes a plurality of scan interval periods. Each of the data driving signals includes a plurality of data driving periods, and each of the data driving periods includes a plurality of driving interval periods. In step S730, the driving circuit makes each of the scan signals to be floating or grounding during the scan interval periods. In step S750, the driving circuit makes each of the data driving signals to be floating or grounding during the driving interval periods.

It should be noticed that enough instructions and recommendations of the aforementioned embodiments can be learned for the above method, and details thereof are not repeated.

In summary, the invention provides an electrophoretic display and a driving method thereof, by which when the driving circuit drives a plurality of pixels in the display panel, by adding the driving interval periods to the data driving periods of the data driving signal, and adding the scan interval periods to the scan enable periods in the scan signal, the cross talk phenomenon of the display panel is mitigated and display quality is improved.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. An electrophoretic display, comprising: a display panel, comprising a plurality of column data lines and a plurality of row scan lines; and a driving circuit, coupled to the display panel, respectively providing a plurality of data driving signals to the column data lines, and respectively providing a plurality of scan signals to the row scan lines, wherein each of the scan signals comprises a plurality of scan enable periods, and each of the scan enable periods comprises a plurality of scan interval periods, the driving circuit makes each of the scan signals to be floating or grounding during the scan interval periods, and each of the data driving signals comprises a plurality of data driving periods, each of the data driving periods comprises a plurality of driving interval periods, and the driving circuit makes each of the data driving signals to be floating during the driving interval periods, wherein the data driving periods comprise a first data driving period and a second data driving period, the data driving signal is floating during the driving interval periods of the first data driving period, and the data driving signal is equal to a first display reference signal in the time sections of the first data driving period other than the driving interval periods, the data driving signal is floating during the driving interval periods of the second data driving period, and the data driving signal is equal to a second display reference signal in the time sections of the second data driving period other than the driving interval periods, where the voltage of the second display reference signal is lesser than that of the first display reference signal.

2. The electrophoretic display as claimed in claim 1, wherein the driving circuit makes each of the scan signals to be equal to a first display reference voltage in time sections other than the scan interval periods in each of the scan enable periods according to a display data displayed in the scan enable period according to the scan signal.

3. The electrophoretic display as claimed in claim 2, wherein the driving circuit makes each of the data driving signals to be equal to a second display reference voltage in time sections other than the driving interval periods in each of the data driving periods according to the display data displayed in the data driving period according to the data driving signal.

4. The electrophoretic display as claimed in claim 3, wherein a pixel gray level of the display panel corresponding to the display data is determined according to a voltage difference between the first display reference voltage and the second display reference voltage.

5. The electrophoretic display as claimed in claim 1, wherein in a frame period, one of the data driving periods of each of the data driving signals corresponds to one of the scan enable periods of each of the scan signals, and in the corresponding scan enable periods and the data driving periods, each of the scan interval periods corresponds to each of the driving interval periods.

6. The electrophoretic display as claimed in claim 1, wherein the driving circuit makes each of the scan signals to be floating during periods other than the scan enable periods.

7. The electrophoretic display as claimed in claim 1, wherein the driving circuit makes each of the data driving signals to be floating during periods other than the data driving periods.

8. The electrophoretic display as claimed in claim 1, further comprising:

a controller, coupled to the driving circuit, and providing a control signal to the driving circuit, wherein the driving circuit generates the data driving signals and the scan signals according to the control signal.

9. A method for driving an electrophoretic display, wherein the electrophoretic display comprises a display panel, and the display panel comprises a plurality of column data lines and a plurality of row scan lines, the method for driving the electrophoretic display comprising: respectively providing a plurality of data driving signals to the column data lines, and respectively providing a plurality of scan signals to the row scan lines, wherein each of the scan signals has a plurality of scan enable periods, and each of the scan enable periods comprises a plurality of scan interval periods, each of the data driving signals comprises a plurality of data driving periods, and each of the data driving periods comprises a plurality of driving interval periods;

making each of the scan signals to be floating or grounding during the scan interval periods;

and making each of the data driving signals to be floating during the driving interval periods, wherein the data driving periods comprise a first data driving period and a second data driving period, the data driving signal is floating during the driving interval periods of the first data driving period, and the data driving signal is equal to a first display reference signal in the time sections of the first data driving period other than the driving interval periods, the data driving signal is floating during the driving interval periods of the second data driving period, and the data driving signal is equal to a second display reference signal in the time sections of the second data driving period other than the driving interval periods, where the voltage of the second display reference signal is lesser than that of the first display reference signal.

10. The method for driving the electrophoretic display as claimed in claim 9, further comprising:

making each of the scan signals to be equal to a first display reference voltage in time sections other than the scan interval periods in each of the scan enable periods according to a display data displayed in the scan enable period according to the scan signal.

11. The method for driving the electrophoretic display as claimed in claim 10, further comprising:

making each of the data driving signals to be equal to a second display reference voltage in time sections other than the driving interval periods in each of the data driving periods according to the display data displayed in the data driving period according to the data driving signal.

12. The method for driving the electrophoretic display as claimed in claim 9, wherein a pixel gray level of the display panel corresponding to the display data is determined according to a voltage difference between the first display reference voltage and the second display reference voltage.

13. The method for driving the electrophoretic display as claimed in claim 9, wherein in a frame period, one of the data driving periods of each of the data driving signals corresponds to one of the scan enable periods of each of the scan signals, and in the corresponding scan enable periods and the data driving periods, each of the scan interval periods corresponds to each of the driving interval periods.

14. The method for driving the electrophoretic display as claimed in claim 9, further comprising:

making each of the scan signals to be floating during periods other than the scan enable periods.

15. The method for driving the electrophoretic display as claimed in claim 9, further comprising:

making each of the data driving signals to be floating during periods other than the data driving periods.

* * * * *